United States Patent [19]

Guin et al.

[11] Patent Number: 4,644,883

[45] Date of Patent: Feb. 24, 1987

[54] AUTOMATIC RIB CUFF MACHINE

[75] Inventors: Carmen N. Guin, Tupelo; Sammy Hood, Myrtle, both of Miss.

[73] Assignee: Denton Mills, Inc., New Albany, Miss.

[21] Appl. No.: 813,479

[22] Filed: Dec. 26, 1985

[51] Int. Cl.[4] ..... D05B 33/00

[52] U.S. Cl. ..... 112/121.29; 112/272

[58] Field of Search ..... 112/121.29, 121.15, 112/121.11, 121.12, 272, 271, 130

[56] References Cited

U.S. PATENT DOCUMENTS

| | | | |
|---|---|---|---|
| 2,483,138 | 9/1949 | Helmer | 112/272 |
| 3,754,522 | 8/1973 | Miller et al. | 112/272 |
| 4,152,996 | 5/1979 | Van Amburg | 112/272 X |
| 4,343,255 | 8/1982 | Kelly et al. | 112/121.29 X |
| 4,438,714 | 3/1984 | Smith et al. | 112/272 X |
| 4,530,295 | 7/1985 | Adamski et al. | 112/121.29 X |
| 4,550,670 | 11/1985 | Thompson et al. | 112/121.29 X |
| 4,580,509 | 4/1986 | Scholl et al. | 112/121.29 X |

*Primary Examiner*—H. Hampton Hunter

*Attorney, Agent, or Firm*—Hill, Van Santen, Steadman & Simpson

[57] ABSTRACT

An automatic rib cuff machine which allows a single operator to attach sleeves to cuffs and wherein the machine automatically sews a sleeve to a cuff when the operator places the sleeve blanket into the machine and actuates an electric eye which initiates the sewing machine to sew the sleeve to the cuff and wherein a second electric eye operates a cutter to cut the cuff web between adjacent units and wherein a first conveyor conveys the completed cuff sleeve to a stacker which is actuated by a third electric eye to stack the cuffs on a second conveyor. The operator can control the second conveyor to return the stacked cuffs to her and the machine allows a single operator wherein the machine of the prior required two operators to operate it and cut the sleeves apart.

4 Claims, 8 Drawing Figures

AUTOMATIC RIB CUFF MACHINE

BACKGROUND OF THE INVENTION

1. Field of the Invention

This invention relates in general to sewing cuffs on sleeves such as used, for example, in children's pajamas of blanket and single knit jersey fabrics.

2. Description of the Prior Art

The prior art apparatus and method comprised a operator picking up a sleeve and loading it into a sewing machine and the sewing machine joins the sleeve and the cuff together. As the operator inserts a second sleeve to be attached to the cuff, the first sleeve which has previously been attached to the cuff is still attached to the cuffing material and, thus, it is necessary for a second operator to separate the two sleeves by cutting them apart as, for example, with scissors. Thus, in the prior art system approximately 175 dozen a day of sleeves could be made when the operator did the sewing, clipping and stacking.

SUMMARY OF THE INVENTION

The present invention provides an automatic sewing, cutting and stacking machine for setting cuffs on sleeves and increases the production to approximately 450 dozen sleeves per day wherein the prior art machine and method constructed approximately 175 dozen per day. The new method and machine eliminates one operator who has to clip and stack the sleeves and in the machine of the invention, the operator puts the garment into the machine and the machine automatically sews the sleeve to the cuff. The machine then automatically cuts the cuffed sleeves apart and stacks the sleeves with an automatic stacker. The operator can actuate a second conveyor to return the stack sleeves to her for packing in boxes. Thus, the present invention allows a single operator to sew the sleeves to the cuffs, and the machine automatically separates the cuffed sleeves apart and automatically stacks the sleeves for packing. With a new method of the invention, the training time for an operator was decreased from six weeks using the old machine to one week using the new machine.

The machine uses three electric eyes to actuate the machine with the first electric eye detecting when the operator places a new sleeve into the machine and actuates the sewing machine head to join the sleeve to the cuff. A second electric eye actuates a cutter for cutting two sleeves apart and the cuffed sleeve is supplied to a first conveyor which moves it to a stacker which is actuated by a third electric eye to remove the sleeve from the first conveyor and stack it on a second conveyor. The second conveyor is actuated by the operator by depressing a switch so as to return the stacked sleeves to the front of the machine where the operator is located. It is an object of the present invention to provide an improved machine for attaching cuffs on sleeves which is more efficient and quicker than the machines of the prior art.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

DESCRIPTION OF THE PREFERRED EMBODIMENTS

Figure 1:
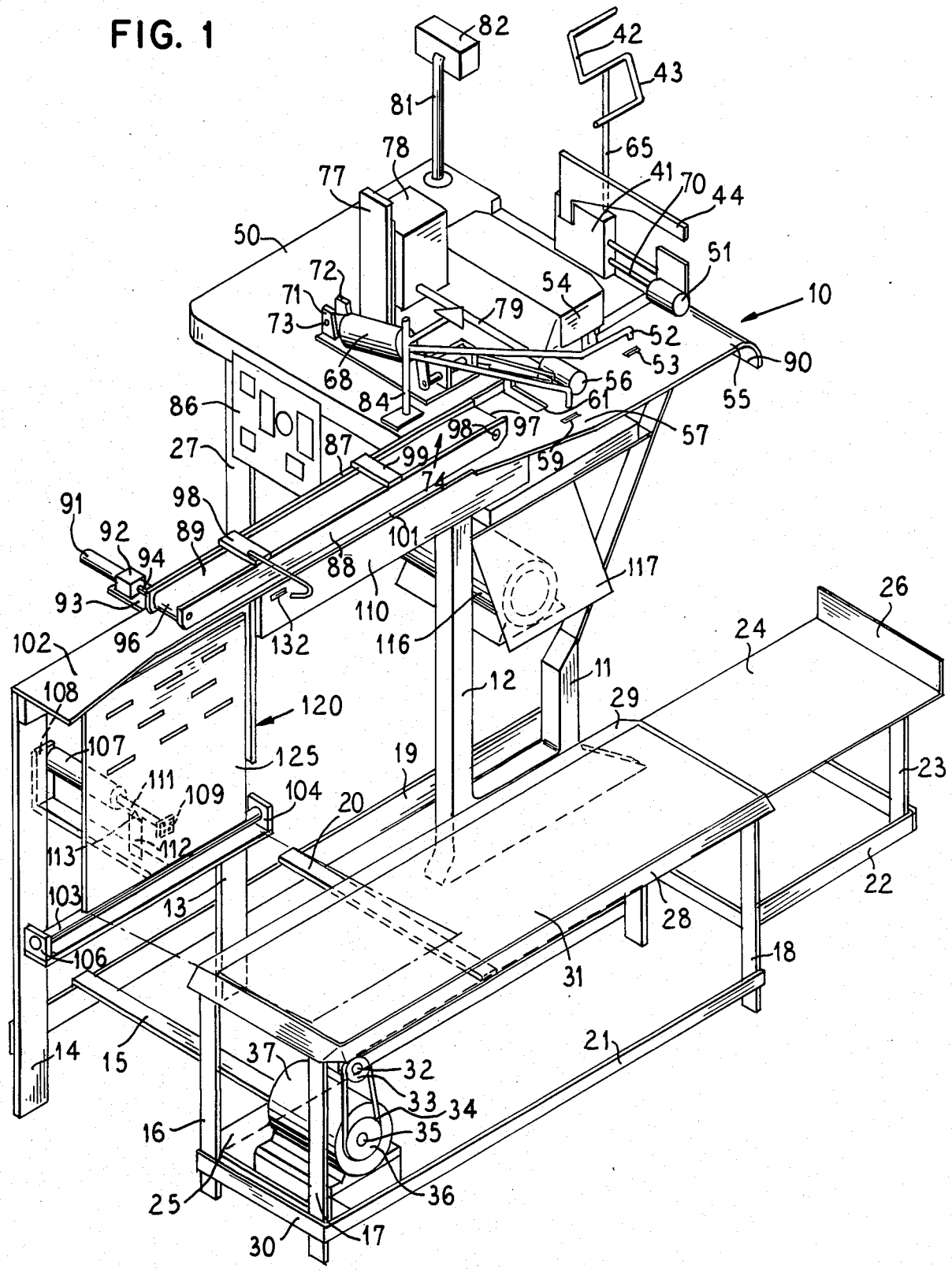
FIG. 1 is a perspective view of the invention.
Figures 2, 5, 6:
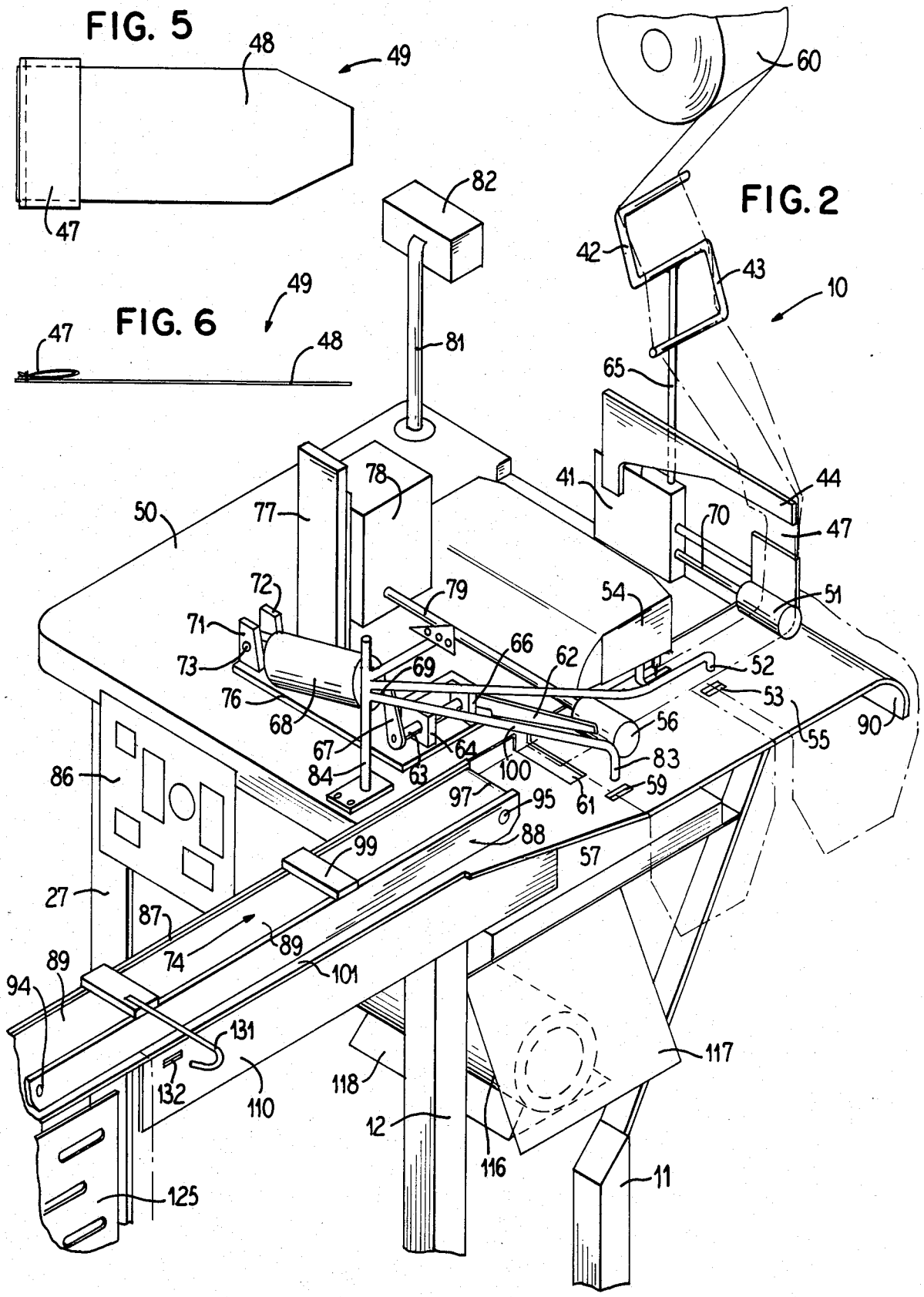
FIG. 2 is an enlarged cut-away view of the machine.
FIG. 5 is a detailed view illustrating the finished sleeve and cuff.
FIG. 6 illustrates in side elevational view a completed sleeve with cuff.

FIGS. 1 and 2 illustrates the sleeve cuffing machine 10 of the invention which comprises a frame member with legs 11, 12, 13 and 14 and a longitudinal frame member 19 and cross-frame members 15 and 20 which extend to a longitudinal frame member 25. Legs 16, 17, 18 form a second conveyor structure and have brace members 21, 30 and 25 as illustrated. Frame members 22 and 23 support an extending receiving shelf 24 which has an edge 26 as illustrated.

The legs 16, 17 and 18 support a top 28 upon which is mounted a second conveyor 31 which is formed with a belt which passes over a roller 32 which carries a pulley 33. A belt 34 passes over the pulley 33 and over the pulley 36 which is attached to the output shaft 35 of an electric motor 37 mounted on the frame portion as illustrated.

A metering device 41 is mounted on a table 50 which is supported by the frame members as, for example, by the vertical member 27 and carries an S-shaped guide 42 and 43 which is supported from the metering device 41 by suitable support 65 and webbing material 60 passes from a suitable support through the portions 42 and 43 of the metering device 41 such that it is folded and passes over a guide arm 44 and under a roller 51 which is supported by a shaft 70 from the metering device 41. The metering device 41 in combination with the members 42, 43 and 44 fold the cuffing material 47 as illustrated in FIG. 5 and passes it under roller 51 and to a roller 56 which is connected by a shaft 79 to a zero max unit 78 supported by a frame member 77 on the table 50. The metering device 41 and the zero max device 78 are commercially available items and for example the metering device 41 is sold by the Atlanta Attachment Company.

A platform 55 is mounted to the frame of the machine beneath the rollers 51 and 56 and has an extending portion 57 and a downwardly extending portion 90 adjacent the front edge thereof. A sewing machine head 54 is mounted to the table 50 between the rollers 51 and 56 and might be a commercial available model 39500 available from the Union Special Company.

Figure 3:
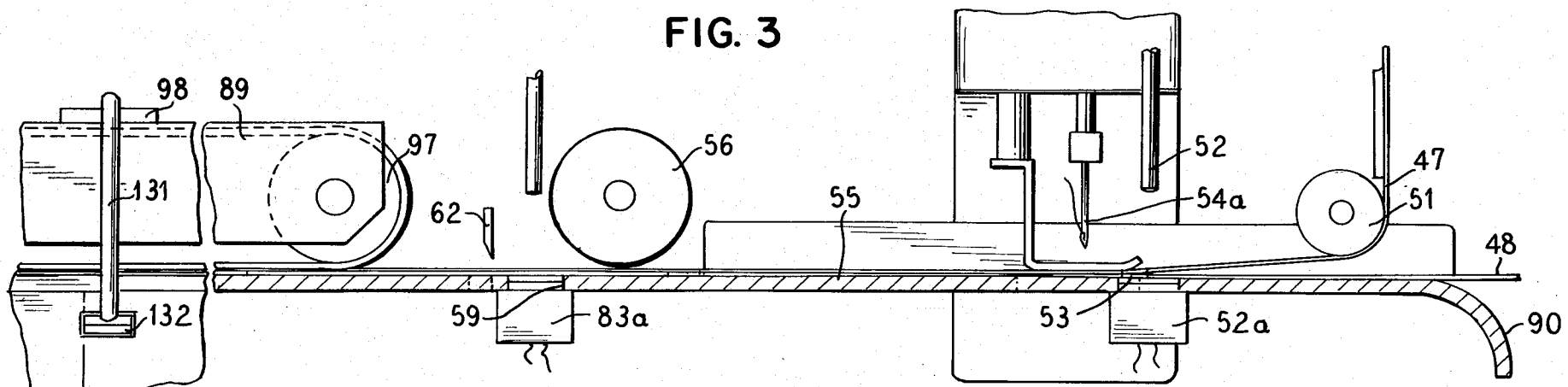
FIG. 3 is a side view illustrating the machine.
Figure 4:
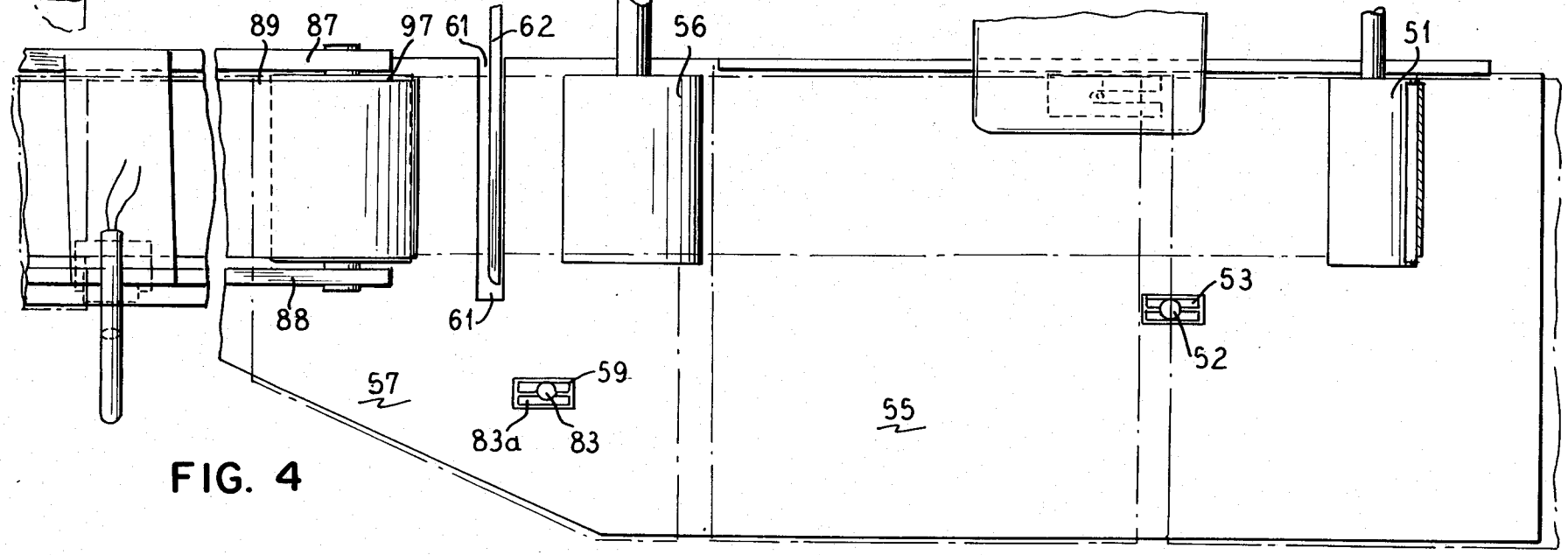
FIG. 4 is a detailed top view.

The present machine is designed for applying cuffs 47 to sleeve material 48 as illustrated in FIG. 5 so as to form a completed sleeve 49. Cuffing material 47 passes between the rollers 51 and 56 and the sleeve material 48 is placed onto the platform 55 by an operator sitting to the right of the machine relative to FIG. 1. A slot 53 in the platform 55 contains a light source 52*a*, and an electric eye 52 is mounted above the slot 53 so as to intercept the light energy from the light source 52*a* illustrated in FIG. 8. When the operator places a sleeve blank 48 into the machine, its front edge intercepts the light energy between light source 52*a* and the electric eye 52 which causes the sewing machine head 54 to be energized so as to sew the cuff rib 47 to the sleeve blank 48 as illustrated in FIGS. 3 4 and 6 to form the cuffed sleeve 49 as illustrated in FIG. 5. The needle 54*a* is illustrated in FIG. 3 which forms a portion of the machine head 54 for sewing the cuff to the sleeve. The sewing machine head 54 is driven by a quick stop electric motor 116 mounted on a portion 118 connected to the frame and the motor 116 is connected by suitable power transmission means, not shown, to the machine head 54 to drive it when the sleeve blanket 48 covers the slot 53. A guard 117 extends from the frame over the end of the motor 116 as illustrated.

Figure 7:
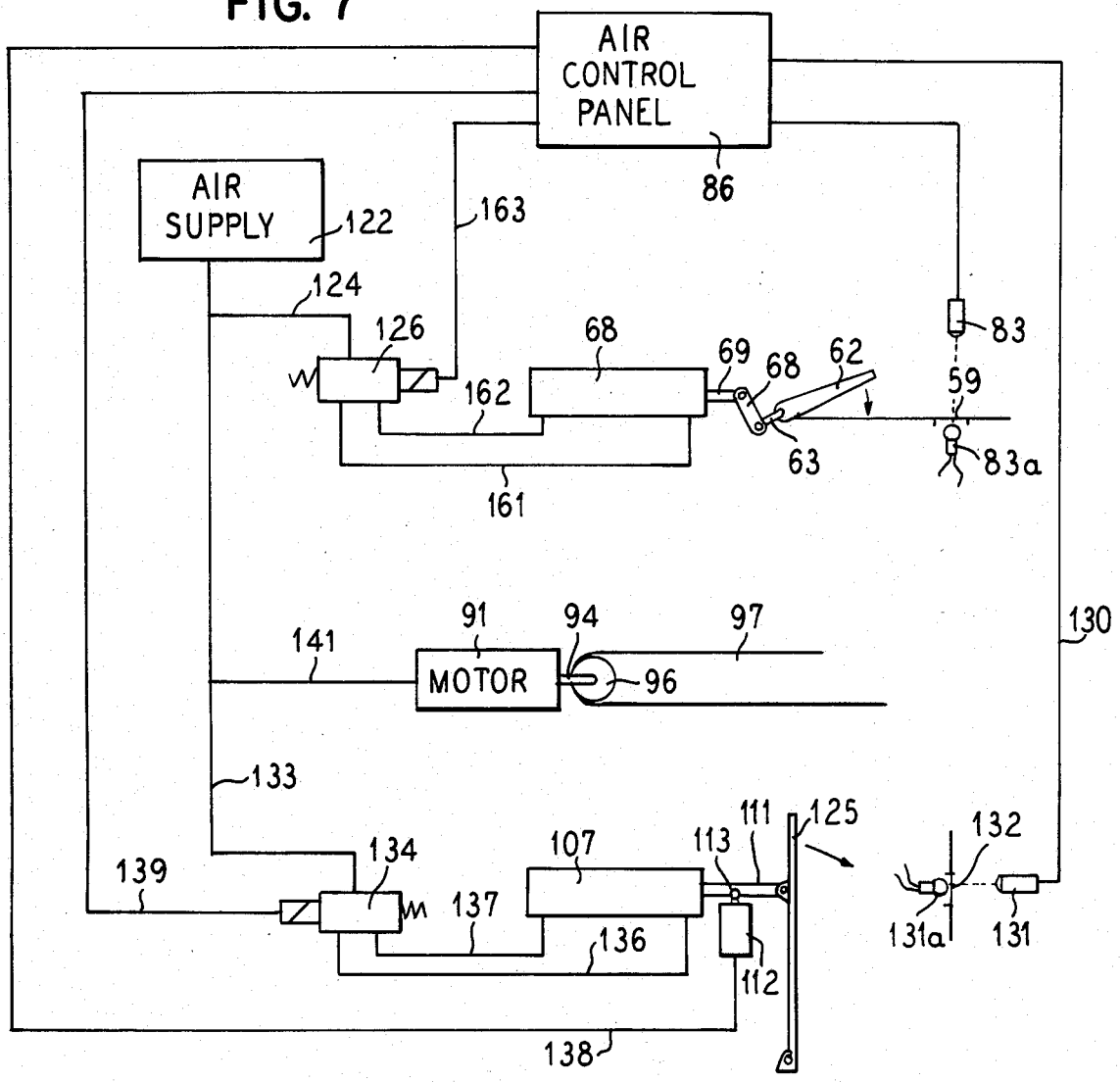
FIG. 7 is a schematic view of the control system.

A slot 59 is formed in the extending portion 57 of the platform 55 and a light source 83*a* as illustrated in FIG. 7 is mounted below the slot 59 and projects light energy on an electric eye 83 mounted to the frame of the machine by a support arm 100 which is connected to a support 84 mounted on the table 50. The electric eye 83 controls a binding cutter which has a cutting blade 62 that moves through a slot 61 in the table 55 so as to cut the cuff web 47 between sleeves. The binding cutter is a commercially available unit available from the Universal Company and comprises an air cylinder 68 which is pivotally mounted by a shaft 73 on brackets 71 and 72 on a planar support member 76 mounted on table 50. The piston rod 69 of the cylinder 68 is pivotally connected to a link 67 which drives a shaft 63 mounted on brackets 64 and 66 on planar member 76 and the shaft 63 drives the cutter blade 62 to cut the cuff web 47.

After the sleeve 49 has been formed and the web 47 has been cut by the cutting blade 62 it passes to the first conveyor 74 which is formed with side frame members 87 and 88 and extend from the left end relative to FIGS. 1 and 2 of the table 55. The conveyor 74 carries a movable belt 89 which passes over rollers 96 and 97 mounted in the ends of the conveyor and the conveyor is driven by an output shaft 94 which is connected to a gear reduction 92 which is connected to an air motor 91 to drive the conveyor. The air motor 91 and gear reduction 92 are supported from the frame by frame member 93 as illustrated. The sleeves 49 pass under the conveyor 74 which moves them along a table portion 101 and along a downwardly extending cover member 110 attached to the frame of the machine. A slot 132 is formed adjacent the end of the member 110 and an electric eye 131 receives light energy from a light source 131*a* as illustrated in FIG. 7 and actuates a stacker 120 connected to the frame members 13 and 14. The stacker is a commercially available item available from the G & H Manufacturing Company and includes a pivotally mounted stacker panel 125 which is connected to a pivot shaft 103 mounted in brackets 104 and 106 connected to the frame members 13, 14 of the machine. Also, it includes an air cylinder 107 which has one end connected to a bracket 108 connected to the frame member 14 and has a piston shaft 111 pivotally connected to a bracket 109 mounted on the pivot stacker plate 125. A microswitch 112 has a switch contact 113 which engages the shaft 111 to produce a signal for reversing the stacker air cylinder 107.

The stacker 120 moves the sleeves to the second conveyor 31. The motor 37 intermittently upon demand of the operator drives the second conveyor 31 to move the stacked sleeves from the left end relative to FIG. 1 to the table 24 adjacent the operator where she can tie them in bundles and remove them from the machine.

An air control panel 86 is mounted to the frame member 27 as illustrated and controls the air motor 91 which drives the first conveyor 89 as well as the air cylinders 68 and 107 of the cutter and the stacker.

A control box 82 is mounted on a support arm 81 and is a commercially available unit from ARA Electric Company. The switch for operating the second conveyor 31 may be mounted on the control box 82 so as to periodically actuate the motor 37 as required by the operator who closes the motor control switch.

FIG. 7 illustrates the air system for driving the air motor 91 which moves the first conveyor 89 as well as the cutter cylinder 68 and the stacker 125. An air supply 122 supplies air to the motor 91 through a suitable airline 141 as shown. The cutter cylinder 68 has a pair of airlines 161 and 162 to drive its piston rod 69 in opposite directions and these lines are connected to a valve 126 which receives an input on air line 124 from the air supply 122 and a control signal on line 163 for controlling the valve 126 so as to actuate the cutter and to return the piston to its initial starting position.

The stacker 125 is controlled by the air cylinder 107 and has air lines 136 and 137 which are connected to either end of the cylinder and which are connected to a valve 134 which receives air on line 133 from the air supply 122. The electric eye 131 supplies an input on lead 130 to the air control panel 86 which supplies an electrical signal on line 139 to control valve 134. The microswitch 112 which engages piston rod 111 supplies a signal on line 138 to the air control panel 86.

Figure 8:
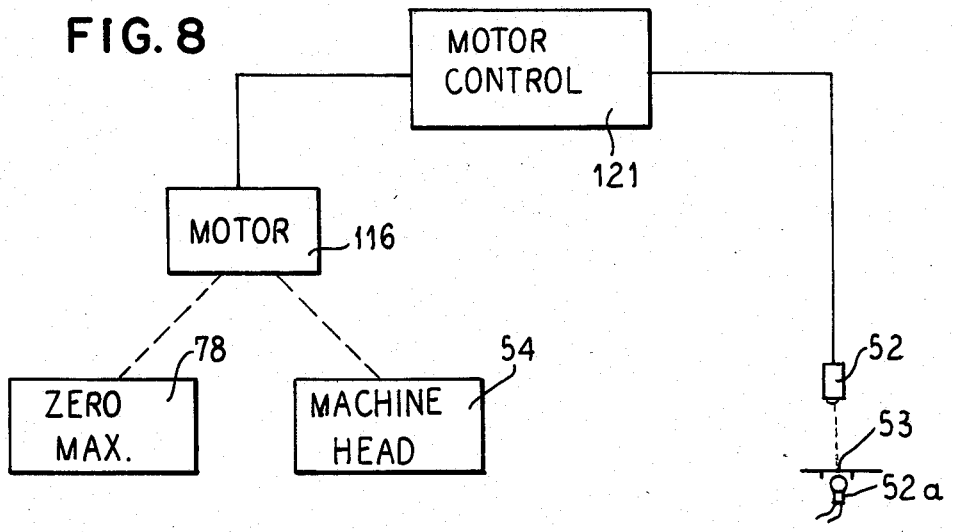
FIG. 8 illustrates the control system for the sewing machine head and zero max.

FIG. 8 illustrates the control system for controlling the quick-start motor 116 which drives the machine head 54. The electric eye 52 is connected to a motor control 121 which is connected to the motor 116 to turn it on and off.

FIGS. 3 and 4 illustrate the rollers 51 and 56 and the web 47 which is sewed by the needle 54*a* of the machine head 54 to the sleeve blank 48. The cutter blade 62 severs the cuff web 47 between sleeves 49 as illustrated.

In operation, the operator loads a sleeve blank 48 onto the platform 55 and it passes over the slot 53, thus, interrupting the light source 52*a* to the electric eye 52 which through the motor control 121 starts the motor 116 which drives the machine head 54, thus, sewing the cuff 47 to the sleeve blank 48 as illustrated in FIGS. 5 and 6. The sleeve blank passes over the slot 59 which energizes the cutter cylinder 68 which actuates the cutter blade 62, thus, severing the cuff webbing 47 between adjacent sleeves 49 as illustrated in FIG. 2. The sleeves then pass down the table 55 under the conveyor 89 which drives them pass the slot 132 to actuate the electric eye 131 which energizes the stacker 120. The stacker 120 then moves the sleeves 49 to the second conveyor 31 where they are stacked on the left end relative to FIG. 1. Periodically, the operator energizes a control switch to start the second conveyor 31 by energizing motor 37 which moves the stacked sleeves to the table 24 against the stop 26. The operator can then tie and remove the sleeves.

In the present invention, there is no wasted rib between the sleeves in that the present invention assures that the web 47 will be cut close to the sleeve blanket 48 whereas in the prior art devices large amounts of cuff ribbing 47 was wasted in that this was cut by scissors and the amount of ribbing between adjacent sleeve portions 48 varied.

The present invention eliminates one operator and greatly increases the production of a single operator in that it automatically energizes the machine head 54 to sew the sleeve blanket 48 to the cuff ribbing 47 and also automatically cuts between finished sleeves and automatically stacks the sleeves.

When a sleeve blank 48 passes beyond slot 53, the sewing machine motor 116 stops.

Although the invention has been described with respect to preferred embodiments, it is not to be so limited as changes and modifications can be made which are within the full intended scope of the invention as defined by the appended claims.

In the claims:

1. A machine for attaching cuffs to a sleeve blank comprising, a frame member with a planar portion, a supply of cuff material supported by said frame member and supplied to said planar member, a sewing machine head mounted on said frame member to receive said cuff material, and said sleeve blanks for sewing them together, first switch means connected to said sewing machine head to actuate it when a sleeve blank is placed on said planar member, second switch means, a cuff material cutter connected to said second switch means and actuated to sever said cuff material between a pair of sleeves, a first conveyor positioned to receive said sleeves after the cuff material has been severed, a stacker mounted to receive sleeves from said first conveyor, third switch means connected to said stacker to actuate it when a sleeve arrives at said stacker, and a second conveyor positioned to receive sleeves from said stacker, said first switch means is a first electric eye and a first light source and said sleeve blank intercepts light energy between said first light source and said first electric eye to actuate said sewing machine head, said second switch means is a second electric eye and a second light source and said sleeve blank actuates said second electric eye to actuate said cuff cutter, said third switch means is a third light source and a third electric eye and said sleeve blank actuates said third electric eye to actuate said stacker.

2. A machine for attaching cuffs to a sleeve blank according to claim 1 including fourth switch means connected to said second conveyor to selectively actuate it.

3. A machine for attaching cuffs to sleeve blanks according to claim 1 wherein said cuff material cutter includes a first air cylinder, a first air valve connected to said first air cylinder, an air supply connected to said first air valve, and an air control connected to said second switch means and to said first air valve to actuate it.

4. A machine for attaching cuffs to sleeve blanks according to claim 3 wherein stacker includes a pivoted stacker plate and a second air cylinder connected to drive said pivoted stacker plate, a second valve connected to said air supply and said second air cylinder and to said air control which is also connected to said third switch means.

* * * * *